US007271783B2

(12) United States Patent
Kodera et al.

(10) Patent No.: US 7,271,783 B2
(45) Date of Patent: Sep. 18, 2007

(54) DISPLAY DEVICE

(75) Inventors: Yoshie Kodera, Chigasaki (JP); Tetsu Ohishi, Hiratsuka (JP); Nobuo Masuoka, Chigasaki (JP); Akinori Maeda, Yokohama (JP); Junichi Ikoma, Yokosuka (JP); Hidenao Kubota, Yokohama (JP)

(73) Assignee: Hitachi, Ltd., Tokyo (JP)

( * ) Notice: Subject to any disclaimer, the term of this patent is extended or adjusted under 35 U.S.C. 154(b) by 688 days.

(21) Appl. No.: 10/684,059

(22) Filed: Oct. 10, 2003

(65) Prior Publication Data

US 2004/0233137 A1 Nov. 25, 2004

(30) Foreign Application Priority Data

May 21, 2003 (JP) ..... 2003-142834

(51) Int. Cl.
*G09G 3/30* (2006.01)

(52) U.S. Cl. ..... 345/76; 345/74.1; 345/205; 315/169.3; 313/241

(58) Field of Classification Search ..... 345/32, 345/74.1, 75.2, 76, 205; 315/169.3; 313/42–44, 313/51, 128, 141, 240–242, 260, 261, 267, 313/283, 285, 484, 491, 497
See application file for complete search history.

(56) References Cited

U.S. PATENT DOCUMENTS

| | | | | |
|---|---|---|---|---|
| 6,114,804 | A * | 9/2000 | Kawase et al. | 313/495 |
| 6,342,875 | B2 * | 1/2002 | Todokoro | 345/74.1 |
| 6,476,547 | B1 * | 11/2002 | Kawase | 313/495 |
| 6,528,939 | B1 | 3/2003 | Kawase | |
| 6,700,330 | B2 * | 3/2004 | Koyama | 315/169.3 |
| 6,885,156 | B2 * | 4/2005 | Tajima et al. | 315/169.3 |
| 2002/0021081 | A1 | 2/2002 | Tajima et al. | |

FOREIGN PATENT DOCUMENTS

| | | | |
|---|---|---|---|
| EP | 08655069 | A2 | 9/1998 |
| EP | 0865069 | A3 | 1/1999 |
| JP | 04-094043 | | 3/1992 |
| JP | 05-114372 | | 5/1993 |
| JP | 10-326581 | | 12/1998 |
| JP | 10-326581 | A | 12/1998 |
| JP | 11-016523 | | 1/1999 |
| JP | 2000-208075 | | 7/2000 |
| JP | 2000-208075 | A | 7/2000 |
| JP | 2001-101965 | | 4/2001 |
| JP | 2001-155666 | | 6/2001 |
| JP | 2001-283750 | | 10/2001 |

* cited by examiner

*Primary Examiner*—Henry N. Tran
(74) *Attorney, Agent, or Firm*—Townsend and Townsend and Crew LLP

(57) ABSTRACT

A back substrate has a plurality of electron emission elements. A display substrate comprises an optically transparent substrate disposed opposite to the back substrate; an accelerating electrode formed on the inner face of the optically transparent substrate for accelerating electron beams emitted from the electron emission elements; and luminescent materials excited by the electron beams to emit light toward the outer face of the optically transparent substrate. A frame member supports the back substrate and display substrate on their peripheries. A vacuum chamber is defined by the back substrate, display substrate, and frame member. A conductor electrically connected to the accelerating electrode is drawn out to the outside of the vacuum chamber. A high voltage connector for supplying an accelerating voltage to the conductor is removably connected to the conductor.

15 Claims, 8 Drawing Sheets

DISPLAY DEVICE

BACKGROUND OF THE INVENTION

The present invention relates to a display device, and more particularly to a display device which is referred to as "Field Emission Display" (hereinafter abbreviated as "FED").

A structure of FED is disclosed, for example, in FIG. 21 of JP-A-2001-101965 (Document 1). This patent document discloses that a back substrate which has electron emission elements comprised of cold cathode elements arranged in matrix on an insulating substrate for use as an electron source is placed in opposition to a display substrate which is provided with luminescent materials of three primary colors R, G, B disposed on an optically transparent substrate made of glass or the like for emitting light through collisions of electrons from the electron source. Document 1 also discloses that a supporting frame hermetically seals the two substrates with frit glass between the peripheral edges thereof to maintain the interior under vacuum in a range of approximately $10^{-5}$ to $10^{-7}$ torr. A conductive metal reflective film (metal back) is also provided over the luminescent materials for use as an accelerating electrode which is supplied with a high voltage for accelerating electrons from the electron emission elements (hereinafter called the "accelerating voltage").

Structures for supplying the accelerating voltage to the metal back are disclosed, for example, in JP-A-5-114372 (Document 2), JP-A-4-94043 (Document 3), JP-A-10-326581 (Document 4), and the like. The structure disclosed in Document 2 comprises a high voltage terminal which extends through a back substrate from the back of a vacuum chamber and has a leading end connected to a metal back, as shown in FIGS. 1 to 3 of Document 2. The structure disclosed in Document 3 comprises a display substrate which forms part of a vacuum chamber formed with a throughhole extending therethrough, and a high voltage terminal inserted into the throughhole and brought into contact with a conductor connected to a metal back, as shown in FIGS. 1 and 2 of Document 3. The structure disclosed in Document 4 comprises a cylindrical recess formed in a display substrate or a back substrate of a vacuum chamber, a conductor drawn out from a metal back to the recess, and a high voltage terminal connected to the conductor in the recess.

SUMMARY OF THE INVENTION

In the aforementioned Documents 2 and 3, the high voltage terminal for supplying a high voltage (accelerating voltage) to the metal back is passed through the back substrate or display substrate which forms part of the vacuum chamber (or is disposed within the vacuum area). It is therefore necessary to seal the throughhole with sealing glass or the like in order to maintain the vacuum within the vacuum chamber. On the other hand, the structure described in the aforementioned Document 4 additionally requires a hollow member for forming the cylindrical recess within the vacuum chamber for insertion of the high voltage terminal.

The recess also requires an extra feature for aerially blocking from the vacuum chamber. Further, another extra feature is required for alignment to the conductor drawn out from the metal back when the hollow member is sealed.

Stated another way, in any of the aforementioned Documents 2–4, the high voltage terminal for supplying the accelerating voltage or its associated connection or insertion part (throughhole or recess) interferes with the vacuum chamber (vacuum area). For this reason, an additional feature is again required for preventing air from flowing from the connection insertion part into the vacuum chamber to maintain the vacuum within the vacuum chamber. Consequently, the structure described in any of these documents experiences difficulties in reducing the cost.

Moreover, in any of the documents, the high voltage terminal is brought into contact with or joined to the conductor drawn out from the metal back in a narrow region within the vacuum area (vacuum chamber) and out of the image display area, when the FED is viewed from an observer. This structure implies a problem of a low workability for connecting the high voltage terminal to the metal back.

The present invention has been made in view of the problems mentioned above, and its object is to provide a display device which is capable of supplying an accelerating voltage in a simple structure. With this structure, the present invention aims at reducing the cost and improving the workability.

To achieve the above object, the present invention is characterized in that a conductor electrically connected to an accelerating electrode is drawn out of a vacuum chamber surrounded by a display substrate, a back substrate, and a frame member, and the conductor is applied with an accelerating voltage. Specifically, the conductor is drawn out to a predetermined region outside of a vacuum area (i.e., outside of the frame member) of the display substrate formed with the accelerating electrode, and a connector for applying the accelerating voltage is connected to the conductor.

With the configuration as described above, since the conductor connected to the connector for applying the accelerating voltage is drawn out of the vacuum area, the connection of the conductor with the connector will not interfere with the vacuum chamber. Consequently, this eliminates the need for sealing the connection as well as the need for adding extra elements for the maintenance of vacuum within the vacuum chamber. It is therefore possible to realize a structure for applying the accelerating electrode with the accelerating voltage without significantly increasing the cost. Also, since the connection is located outside of the vacuum area, the conductor can be readily connected to the connector.

Further, in the present invention, the conductor and connector are designed such that the conductor can be removably connected to the connector. With the conductor and connector thus designed, a display panel including the vacuum chamber can be readily removed from a set body, thereby significantly improving the workability in the manufacturing and assembly of the set.

Other objects, features and advantages of the invention will become apparent from the following description of the embodiments of the invention taken in conjunction with the accompanying drawings.

DETAILED DESCRIPTION OF THE EMBODIMENT

Figure 1:
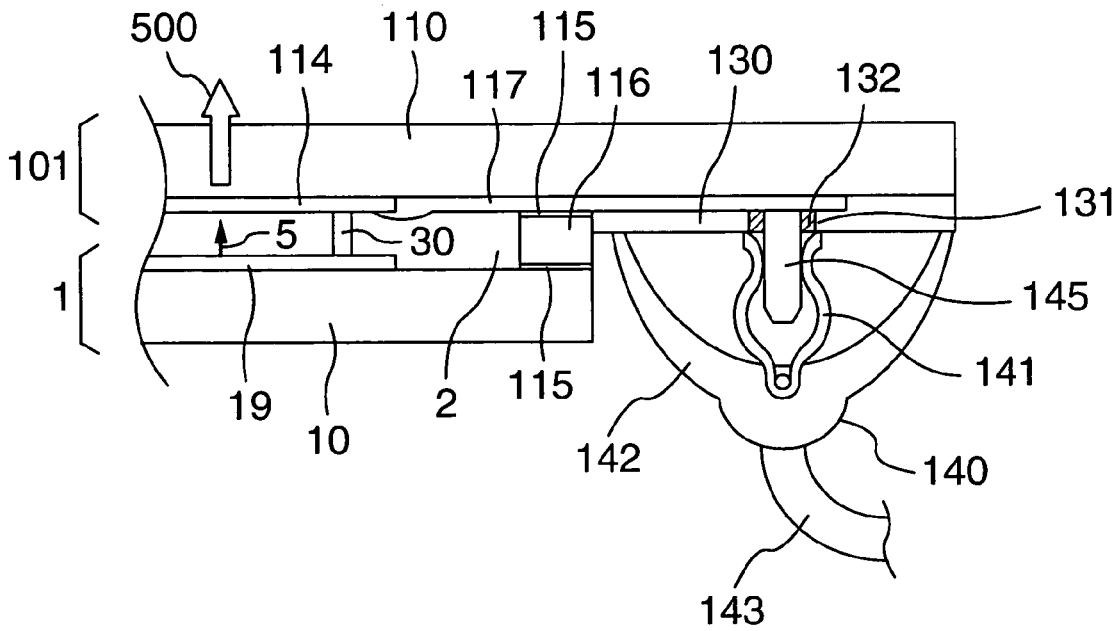
FIG. 1 is a schematic diagram generally illustrating a flat display device according to a first embodiment of the present invention.

In the following, embodiments of the present invention will be described in detail with reference to the accompanying drawings, wherein common parts are designated the same reference numerals through all the drawings.

FIG. 1 is a schematic diagram generally illustrating a flat display device according to a first embodiment of the present invention. In FIG. 1, the flat display device comprises an optically transparent substrate 110 made of glass or the like, which forms part of a display substrate 101; an insulating substrate 10 which forms part of a back substrate 1; and a supporting frame 116 which hermetically seals between the optically transparent substrate 110 and insulating substrate 10 to define a vacuum chamber 2. Spacers 30 are also provided between the display substrate 101 and back substrate 1 for withstanding the atmospheric pressure.

Luminescent materials, not shown, are coated on the inner face of the optically transparent substrate 110, and a metal back 114 is formed thereon for use as an accelerating electrode. An electron emission element forming layer 19 is disposed on the inner face of the insulating substrate 10 which opposes the optically transparent substrate 110. The electron emission element forming layer 19 has electron emission elements formed in matrix. A conductor 117 is drawn out of the metal back 114 to a predetermined region outside of the vacuum chamber 2. The conductor 117 is formed in the following manner. After the luminescent materials (not shown) and metal back 114 are formed on the inner face of the optically transparent substrate 110 by conventional techniques, a metal paste, for example, is coated, and a metal thin film (for example, 100 nm thick), which is later formed into the conductor 117, is drawn out of the metal back 114 to a predetermined region out of the vacuum area. Subsequently, the supporting frame 116 is sealingly embedded between the optically transparent substrate 110 and insulating substrate 10 using frit glass 115. In this way, a display panel is completed. Here, the distance between one end of the conductor 117 and one edge or side of the optically transparent substrate 110 is chosen to be in a range of approximately 2 to 5 mm. In other words, the conductor 117 is drawn out to a position which is spaced from the edge of the optically transparent substrate 110 by 2 to 5 mm. Stated another way, the predetermined region extends from one edge of the vacuum area to the position 2 to 5 mm away from the edge of the optically transparent substrate 110. By thus distancing the end of the conductor 117 from the edge of the optically transparent substrate 110 by 2 to 5 mm, the conductor 117 is not at all exposed to the outside to prevent a discharge from a portion of the conductor, which would be otherwise exposed, into the air.

A cover glass 130 having a predetermined thickness large enough to withstand the accelerating voltage is secured on the inner face of the optically transparent substrate 110 with frit glass (not shown) outside of the vacuum chamber 2. The cover glass 130 covers the conductor 117, and comprises a throughhole 131. Then, a metal rod of the high voltage terminal 145 is implanted on the conductor 117 within the throughhole 131 for connection to the conductor 117. The connection can be made by applying known bonding techniques such as laser welding, conductive adhesive, metal bonding, and the like. After the connection, the throughhole 131 is sealed by sealing glass 132 to fix the metal rod of the high voltage terminal 145. This metal rod extends in a direction orthogonal to a plane which includes the conductor 117.

As illustrated in FIG. 1, a high voltage applying connector 140 connected to FBT (not shown) is fitted over the metal rod of the high voltage terminal 145. A supplied accelerating voltage of 10 kV, which passes through the conductor 117, is applied to the metal back 114 connected to the conductor 117. The application of the accelerating voltage causes electron beams 5 emitted from the electron emission element forming layer 19 to accelerate toward the optically transparent substrate 110, collide with the luminescent materials, not shown, to excite the luminescent materials which are thus driven to emit exiting light 500. The high voltage applying connector 140 is removably fitted over the metal rod (i.e., the conductor 117) of the high voltage terminal 145. With this structure, the display panel integrated with the conductor 117 can be configured for attachment to and removal from a set body of the display device, not shown. This facilitates the attachment of the display panel to the set body as well as the removal of the display panel from the set body, thereby improving the workability associated with the assembly and disassembly of the set.

The high voltage applying connector 140 comprises a bifurcated contactor 141 in contact with the metal rod of the high voltage terminal 145; an anode cap 142 made of silicone rubber or the like and having the insulating property; and a high voltage wire 143.

The accelerating voltage supplied from the FBT (not shown) is supplied to the contactor 141 through the high voltage wire 143, and applied to the metal rod of the high voltage terminal 145 inserted into and sandwiched by the bifurcated contactor 141. The end of the conductor 117, the metal rod of the high voltage terminal 145, and the outside of the contactor 141 are covered with the anode cap 142, so that even if a metal material approaches to these components, no air discharge will be produced between the metal material and components.

As will be apparent from the foregoing description, since the conductor 117 is drawn out to a predetermined region outside of the vacuum chamber 2, and the high voltage terminal 145 is connected to the conductor 117 in the air, the first embodiment features that the optically transparent substrate 110 is longer than the insulating substrate 10 in at least one direction.

As described above, the flat display device according to the first embodiment draws the conductor 117 from the metal back 114 to a predetermined region outside of the vacuum chamber 2 which is hermetically sealed by the optically transparent substrate 110, insulating substrate 10, and supporting frame 116 to produce a vacuum atmosphere therein, viewed from a light exiting side 500 (from an observer). Therefore, the metal rod of the high voltage terminal 145 can be disposed on the conductor 117 in the atmosphere. Consequently, a wide space extends in three directions except for a direction toward the vacuum chamber 2 (for example, in the upward, downward and rightward directions on the sheet of FIG. 1), and accordingly facilitates a work for disposing the metal rod of the high voltage terminal 145 on the conductor 117 outside of the vacuum chamber 2 covered with the cover glass 130, thereby making it possible to improve the working efficiency.

Figure 2:
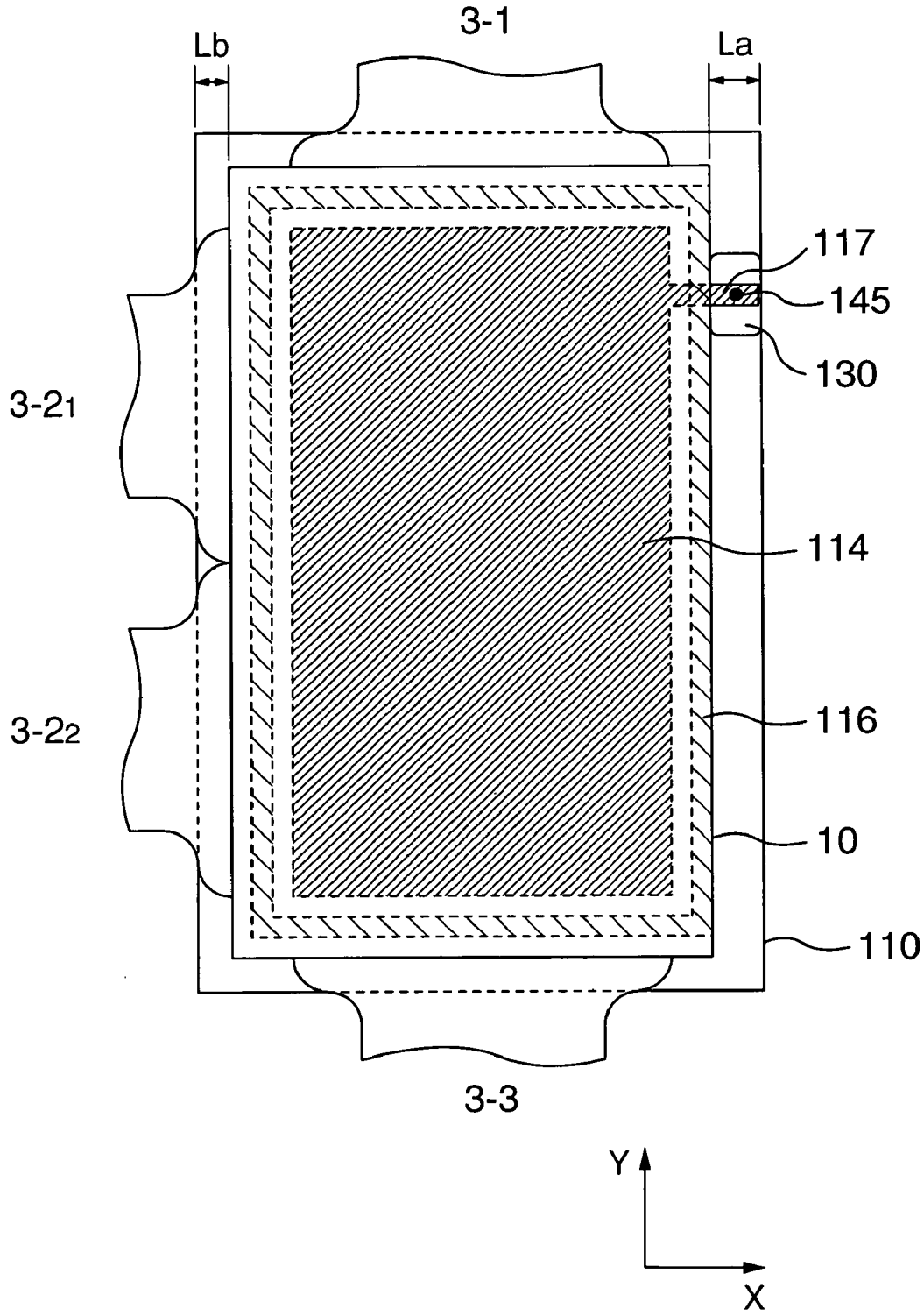
FIG. 2 shows the flat display device illustrated in FIG. 1, when viewed from a back substrate.

FIG. 2 shows the flat display device illustrated in FIG. 1 when viewed from the back substrate side. In FIG. 2, electron emission element driving wires 3-1, 3-2$_1$, 3-2$_2$, 3-3 can be seen. In the present invention, the high voltage terminal 145 is disposed on the conductor 117 drawn out of the metal back 114 in a direction in which the electron emission element driving wires 3-1, 3-2$_1$, 3-2$_2$, 3-3 are not routed. By doing so, it is possible to avoid intersections of the high voltage wire 143 for supplying the accelerating voltage from the FBT (not shown) to the high voltage terminal 145 with the electron emission element driving wires 3-1, 3-2$_1$, 3-2$_2$, 3-3, facilitate the wiring, prevent electric noise generated from the FBT (not shown) from leaking into the electron emission element driving wires 3-1, 3-2$_1$, 3-2$_2$, 3-3, and reduce the danger of unwanted discharges.

Further, in the present invention, the optically transparent substrate 110 which forms part of the display substrate is larger (longer) than the insulating substrate 10 which forms part of the back substrate at least in a direction orthogonal to the side on which the high voltage terminal 145 is provided (in the X-direction in FIG. 2), wherein a dimension La by which the optically transparent substrate 110 extends over the insulating substrate 10 (closer to the high voltage terminal 145) is equal to or larger than a dimension Lb on the opposite side. In other words, the dimensions La and Lb satisfy the following Equation 1, so that the distances from the center of the optically transparent substrate 110 are not equal:

$$La \geqq Lb \ldots \quad \text{(Equation 1)}$$

In this event, the optically transparent substrate 110 which forms part of the display substrate, and the insulating substrate 10 which forms part of the back substrate are both rectangular. The shape of the vacuum chamber 2 surrounded by the optically transparent substrate 110, insulating substrate 10, and supporting frame (frame member) 116 is also rectangular when viewed from the light exiting side. In the first embodiment, the conductor 117 is disposed on the longer side, as illustrated in FIG. 2. In this event, the dimension La is the distance in the shorter side direction (X-direction) between one longer side of the vacuum chamber 2 and one longer side of the optically transparent substrate 110 which sandwich the region in which the conductor 117 is drawn out. On the other hand, the dimension Lb is the distance in the shorter side direction (X-direction) between the other longer side of the vacuum chamber 2 and the other longer side of the optically transparent substrate 110. The first embodiment shows an example in which the conductor 117 is disposed on one longer side of the optically transparent substrate 110. Alternatively, the conductor 117 may be disposed on a shorter side of the optically transparent substrate 110.

By doing so, it is possible to prevent the size of the flat display device from being unnecessarily large and to efficiently carry out a blank layout for the optically transparent substrate.

Figure 3A:
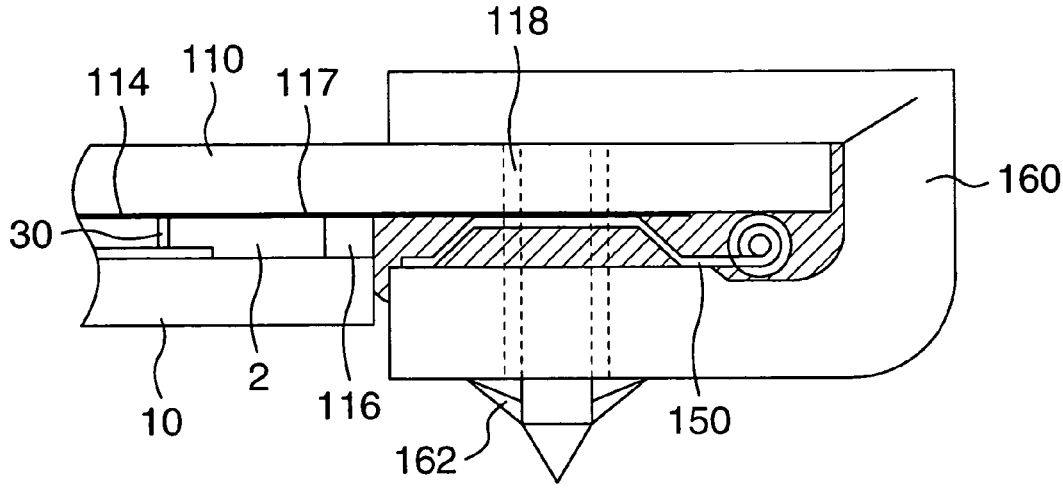
FIGS. 3A and 3B are diagrams illustrating a flat display device according to a second embodiment of the present invention.
Figure 3B:
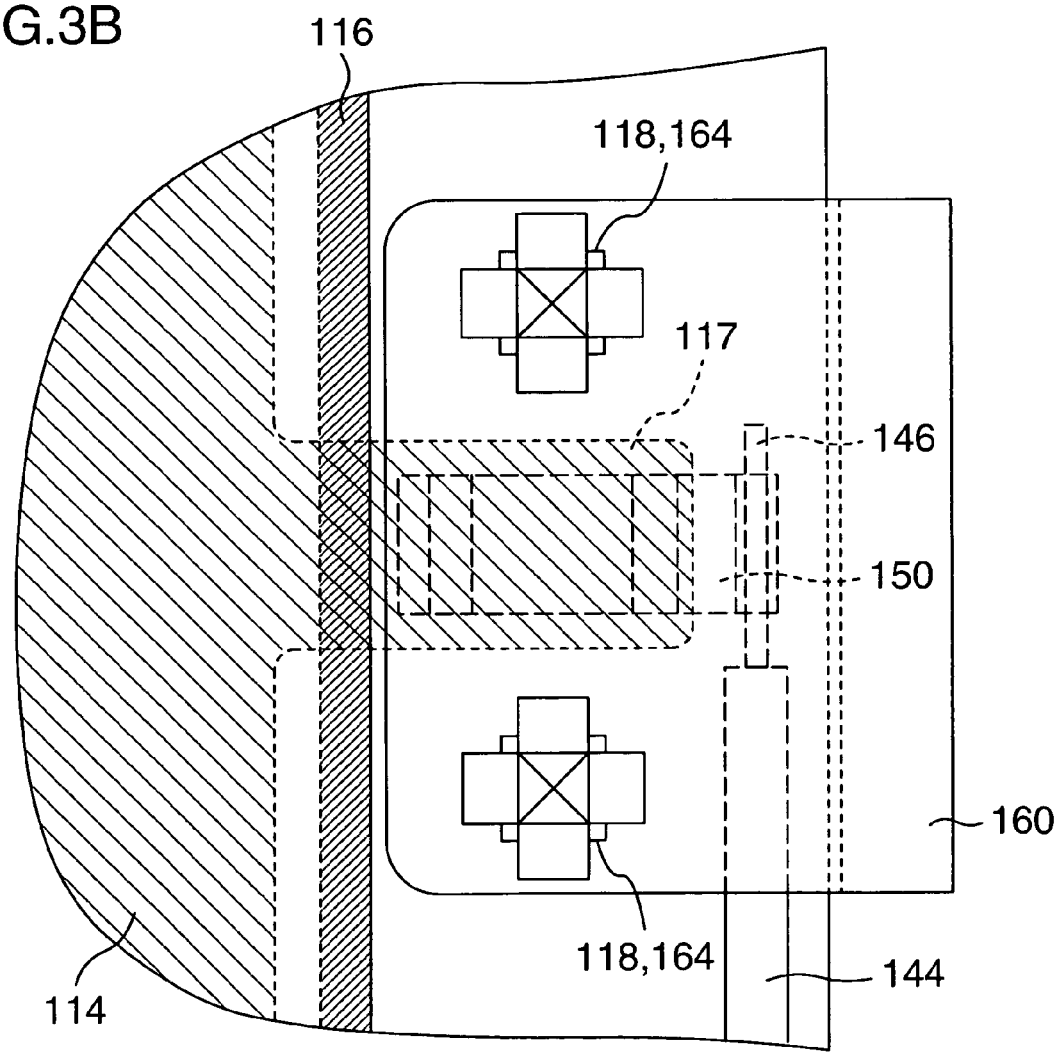

FIGS. 3A and 3B illustrate a display device according to a second embodiment of the present invention. The display device illustrated in FIGS. 3A and 3B is identical to the display device according to the first embodiment illustrated in FIG. 1 except for a structure for applying an accelerating voltage supplied from FBT (not shown) to a conductor drawn out of a metal back. The following description will be made only on differences from FIG. 1 in order to avoid complexity.

FIG. 3A shows a connection structure in the second embodiment when viewed from a lateral face, and FIG. 3B is a plan view when viewed from the insulating substrate side. In FIG. 3, a conductor 117 drawn out of the metal back 114 is formed from a vacuum chamber 2 to the outside of the vacuum chamber 2 on the inner face of an optically transparent substrate 110 in a manner similar to the first embodiment. A pair of throughholes 118, spaced away from each other, are formed through the optically transparent substrate 110 for inserting stoppers 162 of a wire fixture 160, later described, outside of the vacuum chamber 2.

Figure 4:
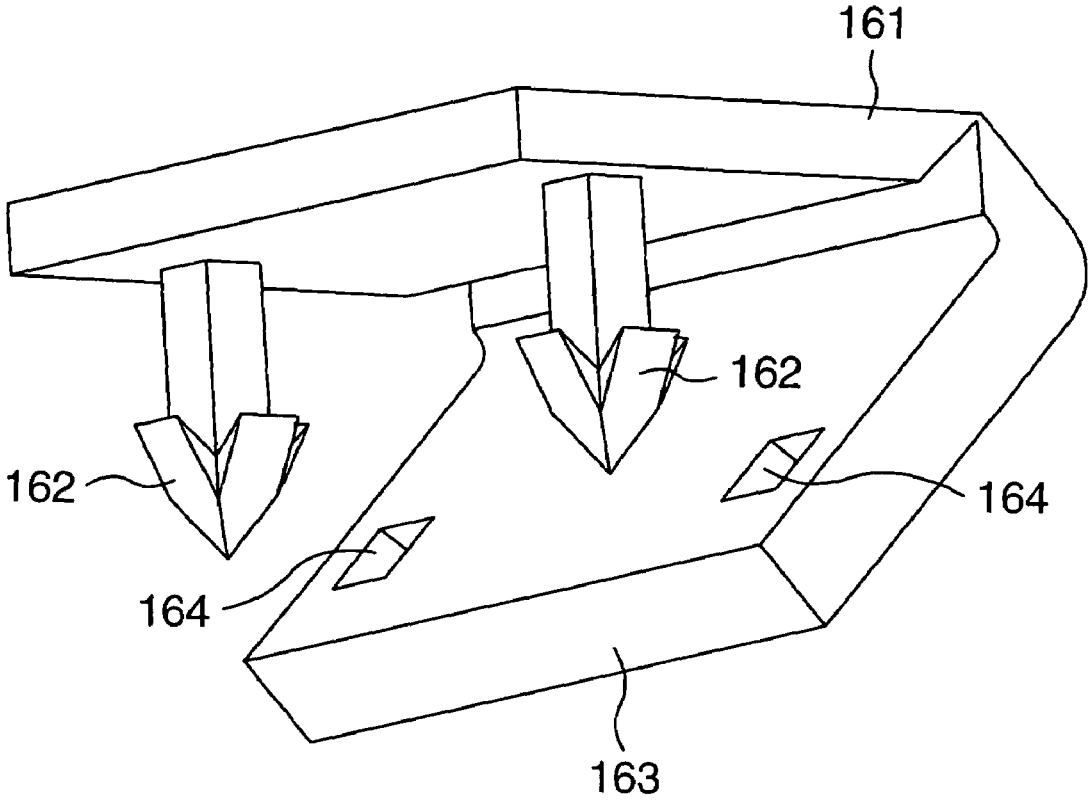
FIG. 4 is a perspective view illustrating a specific example of wire fixture.

The wire fixture 160, which is made of an insulating resin, comprises a base 161 formed with the pair of stoppers 162 spaced by a distance corresponding to the throughholes 118; and a movable plate 163 formed with stopper holes 164 into which the stoppers 162 are inserted, as illustrated in FIG. 4.

On the other hand, an insulating coating is removed from a leading end portion of a high voltage wire 144 from the FBT (not shown) in a region outside of the vacuum chamber 2 to leave a high voltage terminal 146 which is a core line of the high voltage wire 144, as illustrated in FIG. 3B. A metal-made resilient body 150 in the shape of leaf spring is crimped around the high voltage terminal 146.

Figure 5A:
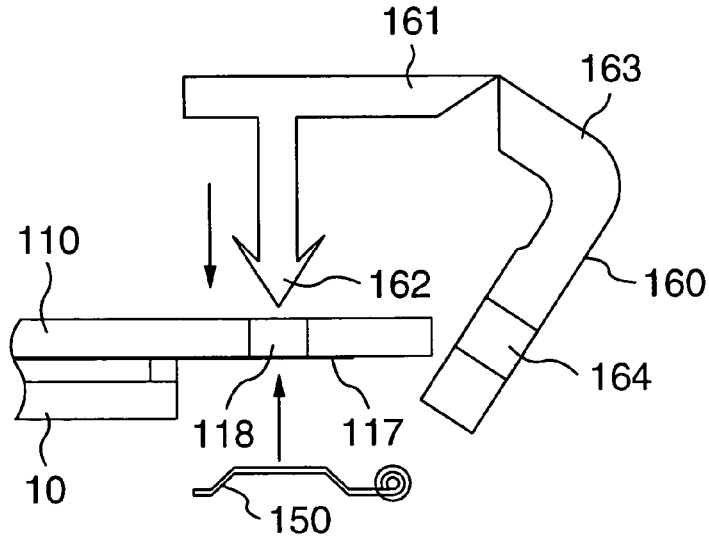
FIGS. 5A to 5D are diagrams showing a connecting method using the wire fixture.
Figure 5B:
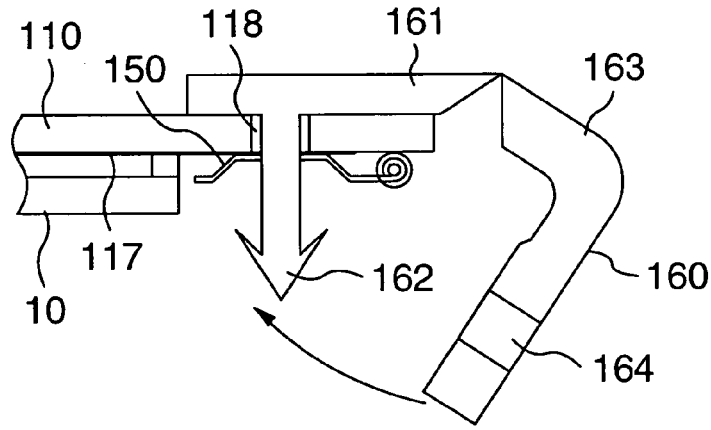
Figure 5C:
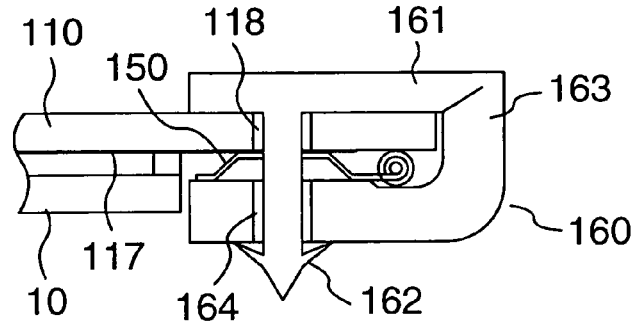

Next, a connecting method for supplying an accelerating voltage from the high voltage wire 144 to the conductor 117 using the wire fixture 160 will be described with reference to FIGS. 5A to 5D. First, as illustrated in FIG. 5A, the resilient body 150 crimped around the high voltage terminal 146 is placed on the conductor 117, and the stoppers 162 of the wire fixture 160 are inserted into the throughholes 118 of the optically transparent substrate 110 from the light exiting (observer) side. Next, as illustrated in FIG. 5B, the movable plate 163 of the wire fixture 160 is moved in a direction indicated by an arrow to sandwich the optically transparent substrate 110 between the base 161 and movable plate 163 to insert the stoppers 162 into the stopper holes 164. Then, as illustrated in FIG. 5C, the resilient body 150 is pressed against and fixed on the conductor 117 using the wire fixture 160.

Figure 5D:
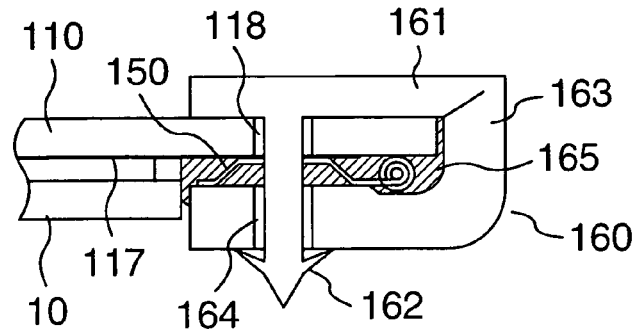

Then, for avoiding the danger of discharge, an insulating member 165 is filled in a gap of the wire fixture 160 and in a gap between the wire fixture 160 and vacuum chamber 2, as illustrated in FIG. 5D. The insulating member 165 used herein may be, for example, made of an insulating resin such as silicon resin, acrylic resin, epoxy resin, or the like.

With the structure described above, the accelerating voltage supplied from the FBT (not shown) can be applied to the conductor 117 drawn out of the metal back 114, so that the second embodiment provides similar advantages to the first embodiment.

In the second embodiment, unlike the first embodiment, the insulating member 165 filled in the gaps disables plugging and unplugging operations. However, since the connection wire can be provided in a region outside of the vacuum chamber 2, wiring and connection can be made after the completion of the vacuum chamber 2. Since the flat display device can be operated for confirming the operation before the insulating member 165 is filled, there are no particular inconveniences. If the flat display device fails in its operation, the stoppers 162 may be cut to reuse the resilient body 150 and high voltage wire 144, leading to a reduction in cost. On the contrary, in the prior art as described in the aforementioned Documents 2–4, since the connection structure is closely incorporated in the vacuum chamber, the reuse is difficult.

Next, a third embodiment will be described. The present invention is characterized by a connecting means provided for applying the accelerating voltage from the FBT (not shown) to the conductor drawn out of the metal back to a predetermined region outside of the vacuum chamber. The present invention can be applied to a metal sheet described in Japanese Patent Application No. 2003-56008 which has been filed by the present inventors for purposes of providing a flat display device which can reduce a charge and facilitate an accurate arrangement of spacers.

Figure 6:
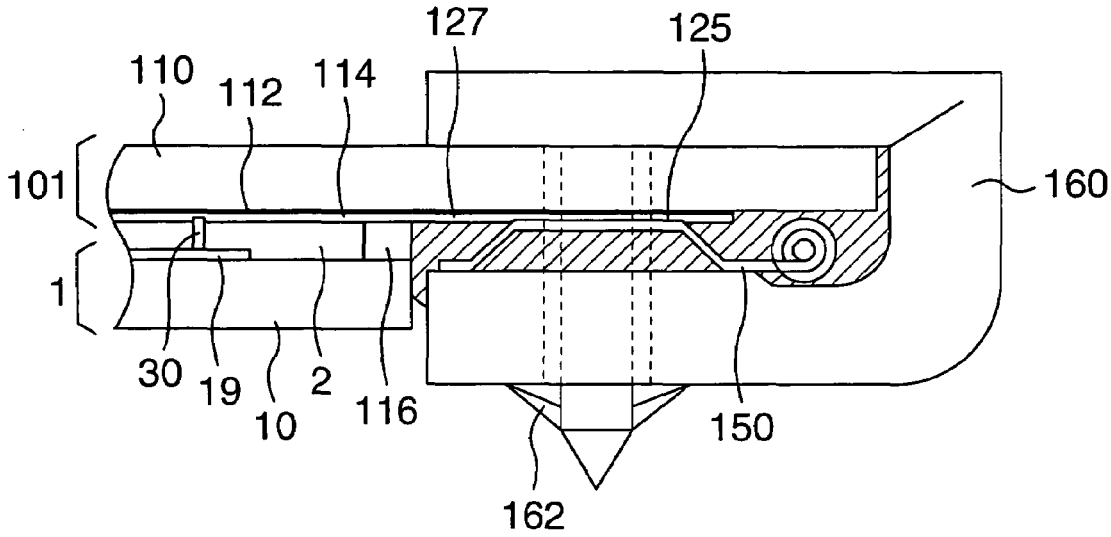
FIG. 6 is a cross-sectional view illustrating a flat display device according to a third embodiment of the present invention.
Figure 7:
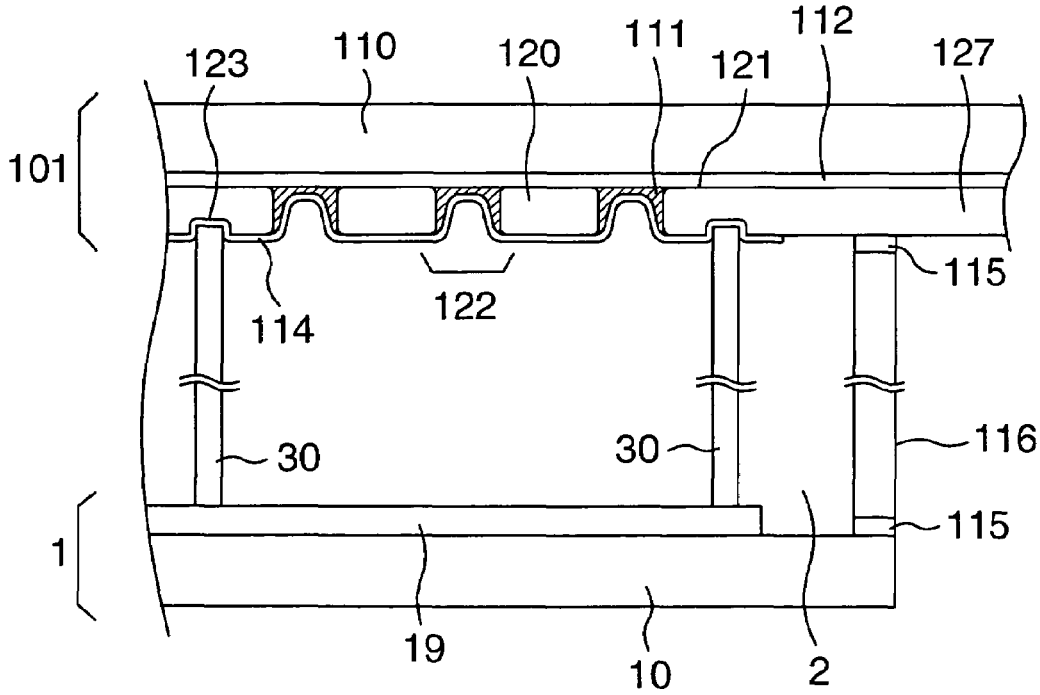
FIG. 7 is an enlarged view illustrating the interior of a vacuum chamber.

FIG. 6 is a schematic diagram generally illustrating a flat display device according to a third embodiment of the present invention, wherein the present invention is applied to the metal sheet described in the aforementioned Japanese Patent Application No. 2003-56008. FIG. 7 is an enlarged view illustrating the interior of the vacuum chamber. In the third embodiment, a display substrate comprises a metal sheet which is provided with a large number of miniature holes arranged in matrix, in which luminescent materials are contained to form a light emission area. A portion of the metal sheet is drawn out to a predetermined region outside of the vacuum chamber to integrally form the conductor as mentioned above. A feature of the third embodiment lies in this structure. In the third embodiment, the connection to the high voltage wire is implemented by the connection structure described in the second embodiment, by way of example. In the following, the third embodiment will be described.

In FIGS. 6 and 7, a display substrate 101 comprises an optically transparent substrate 110 made of glass or the like, transmitted by light; a thin metal sheet 120 having a large number of miniature holes 122 arranged in matrix (in two dimensions); a low melting point adhesive layer 112 for securing the metal sheet 120 to the optically transparent substrate 110; luminescent materials 111 charged into and contained in the miniature holes 122 of the metal sheet 120; and an aluminum (Al) made metal back 114 formed on the metal sheet 120, for example, by vapor deposition.

Similar to a shadow mask used in the Braun tube (CRT), the metal sheet 120 is formed with a large number of miniature holes 122 in matrix within the vacuum chamber 2. These miniature holes 122 are used for charging the luminescent materials 111 thereinto, and the side of the metal sheet 120 closer to the optically transparent substrate 110 is painted substantially in black for use as a black matrix 121 in order to prevent reflection of external light and hence a degradation of contrast. In addition, the side of the metal sheet 120 closer to the back substrate 1 is formed with recesses 123 such as cavities, grooves or the like for inserting spacers 30 thereinto in places. The metal sheet 120 is also provided with a draw-out conductor 127 for a draw-out wire to a predetermined region outside of the vacuum chamber 2 for connection to a high voltage terminal. The draw-out conductor 127 is partially provided with a recess (cavity) 125 for a resilient body 150 which forms part of a high voltage connection structure. The recess 125 is provided for fixing the resilient body 150 at a stable position. The recess 125 may be a hole (throughhole) rather than the cavity. As described above, the resilient body 150 is crimped around (brought into electric contact with) the high voltage terminal 146 which has an electrically conductive property and supplies the accelerating voltage. Then, the resilient body 150 is pressed against the optically transparent substrate 110 in its thickness direction by the wiring fixture 160, and fitted into the recess 125 for fixation.

The back substrate 1 comprises an insulating substrate made, for example, glass or the like; and a cold cathode electron emission element forming layer 19 which has a large number of electron emission elements formed on the insulating substrate 10 for use as an electron source.

The flat display device supports the display substrate 101 and back substrate 1 by the spacers 30, and a supporting frame 116 hermetically seals the display substrate 101 and back substrate 1 with frit glass 115 around the peripheral edges thereof to define the vacuum chamber 2, the interior of which is maintained under vacuum in a range of approximately $10^{-5}$ to $10^{-7}$ torr.

The metal sheet 120 is formed in a manner similar to the shadow mask for use as a color selection mask in the Braun tube (CRT) for a color television to irradiate predetermined luminescent materials with electron beams. Specifically, the metal sheet 120 has a large number of miniature holes 122 formed by etching through an extremely low content carbon steel thin plate made of a Fe—Ni based alloy. The metal sheet 120 is thermally treated at temperatures in a range of 450 to 470° C. equal to or lower than the re-crystallization temperature of steel in an oxidization atmosphere for 10 to 20 minutes for melanization of the surface thereof. Thus, conventional facilities for manufacturing shadow masks can be utilized as they are for manufacturing the metal sheet 120.

The metal sheet 120 used herein has a thickness of 20 to 250 μm. The lower limit of the thickness is chosen to be 20 μm because there are few commercial demands for steel plates having thicknesses not more than 20 μm, and because the metal sheet 120 should be equal to or thicker than the layer of the luminescent material 111, the thickness of which is chosen to be approximately 10 to 20 μm, as will be later described. Also, the metal sheet 120 preferably has a thickness of 250 μm or less because the extremely low content carbon steel thin plate made of the Fe—Ni based alloy is expensive, and because there are few commercial demands for steel plates having thicknesses not less than 250 μm, that is, in view of the cost.

Since the metal sheet 120 has an insulating black oxide film on the surface, produced by the melanization, its side closer to the optically transparent substrate 110 can be used as the black matrix 121. However, the insulating black oxide films are removed from the inner faces of the miniature holes 122 and from the side of the metal sheet 120 closer to the back substrate 1, for example, by sand-blasting for removing charges on the luminescent materials and for providing conductivity to the metal back, so that the inner faces of the miniature holes 122 and the side of the metal sheet 120 closer to the back substrate 1 are electrically conductive. It should be understood that the insulating black oxide films on the sides closer to the back substrate 1 of the draw-out conductor 127 and recess 125 of the metal sheet 120 are also removed by sand-blasting in a similar manner so that they are electrically conductive.

The metal sheet 120 thus processed is secured to the optically transparent substrate 110 with the low melting point adhesive layer 112 (for example, 50° C. or lower). The adhesive layer 112 may be, for example, frit glass that is low melting point glass, coated on the optically transparent substrate 110 to adhere the metal sheet 120 thereon. The resulting assembly is thermally treated at temperatures of 450 to 470° C. for sintering. Alternatively, the adhesive layer 112 may be polysilazane which is a liquid glass precursor. This material may be used for sintering at temperatures equal to or higher than 120° C. to secure the metal sheet 120 to the optically transparent substrate 110.

The optical characteristic of the adhesive layer 112 is not limited to be transparent. For example, glass materials conventionally used for front panel materials of CRT and the like have their light transparencies limited as appropriate to improve the contrast. Likewise, in the present invention, even though the optically transparent substrate 110 is transparent, the adhesive layer 112 may be made of a glass layer, the light transparency of which is limited as appropriate, to advantageously improve the contrast, as is the case with the CRT. The glass can be similar structre which has been conventionally implemented in CRT, and the like.

According to the embodiment described above, the metal sheet 120 is previously formed with a large number of miniature holes 122, subjected to the melanization for the surface, and then secured to the optically transparent substrate 110 with the adhesive layer 112. However, this is not the only process available. Alternatively, for example, the metal sheet 120, which has been thermally treated in an oxidization atmosphere to melanize the surface, may be secured to the optically transparent substrate 110 with the adhesive layer 112, before a large number of miniature holes 122 are formed by etching. Advantageously, the latter process not only provides a similar function to that in the aforementioned embodiment, but also improves an adhesion efficiency because of ease of handling, resulting from the absence of the miniature holes 122 when the metal sheet 120 is secured to the optically transparent substrate 110.

After the metal sheet 120 is secured to the optically transparent substrate 110 with the adhesive layer 112 which is a glass layer, red (R), green (G), and blue (B) luminescent materials 111 are charged into the miniature holes 122 in thicknesses on the order of 10 to 20 μm, respectively. Then, after a film is covered over the luminescent materials 111, a metal back 114 of aluminum, for example, is vacuum deposited in a thickness of approximately 30 to 200 nm. The metal back 114 acts to remove charging on the luminescent materials 111 and to reflect light emitted from the luminescent materials 111 to the front, as well as serves as an accelerating electrode for applying an accelerating voltage for accelerating electron beams from the electron emission element forming layer 19. Of course, the metal back 114 is required to sufficiently transmit electron beams from the electron emission element forming layer 19, so that the thickness of the metal back 114 is set in the aforementioned range from this respect. In particular, the thickness is preferably on the order of 70 nm.

As illustrated in FIG. 7, in the third embodiment, the metal sheet 120 is provided with a plurality of recesses 123 on its side opposite to that on which the black matrix 121 is disposed. The recesses 123 lie within the area of the black matrix 121, when viewed from the optically transparent substrate 110. Even if spacers 30 are inserted into the recesses 123, there is no concern that the spacers 30 affect the trajectory of electron beams which exit from the back substrate 1 and reach the luminescent materials 111. In the present invention, the recesses 123 have a depth which is set in a range of 10 to 125 μm that is approximately one-half of the thickness of the metal sheet 120.

Figure 8:
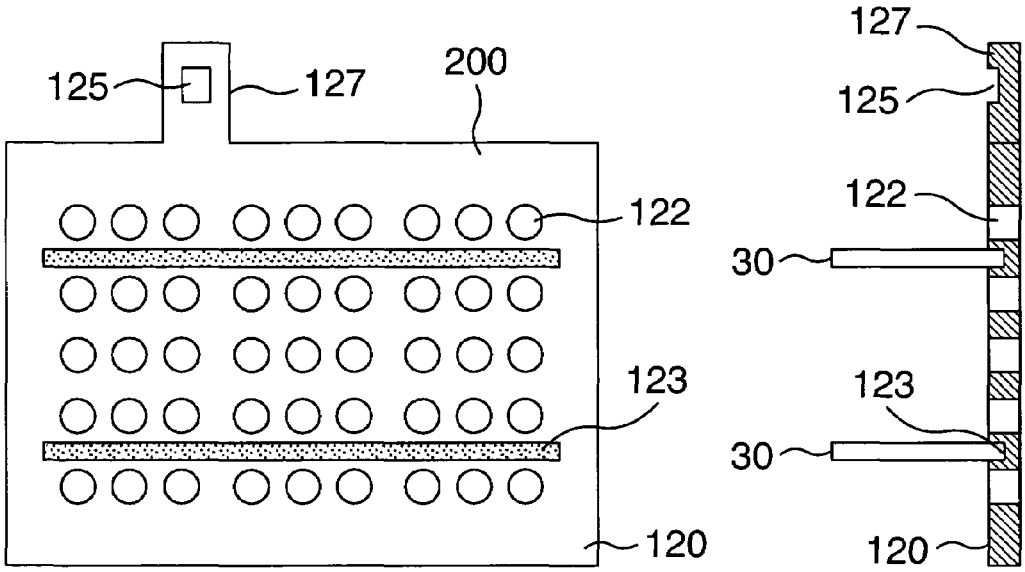
FIG. 8 is a top plan view illustrating a metal sheet when viewed from the back substrate.

FIG. 8 is a top plan view of the metal sheet 120 viewed from the back substrate 1. For readily understanding the illustration, the luminescent materials are omitted in the illustrated metal sheet, and the screen is comprised of five lines by three pixels (one pixel is composed of three color pixels for emitting R-light, G-light, and B-light). It should be understood however that there are actually a large number of recesses 123 for receiving a number of spacers sufficient to withstand the atmospheric pressure over the overall metal sheet 120.

In FIG. 8, the metal sheet 120 comprises a large number of miniature holes 122 which are arranged in matrix (in two dimensions) within the area of the vacuum chamber 200. Pixels are formed by light emitted from the luminescent materials charged into and contained in the miniature holes 122. FIG. 8 shows, by way of example, that the miniature holes 122 are circular. The metal sheet 120 also comprises the draw-out conductor 127 extending to a predetermined region outside of the vacuum chamber area for a draw-out wire for connection to the high voltage terminal, and the recess 125 in a portion of the draw-out conductor 127 for the resilient body 150 which forms part of a high voltage connection structure. The recess 125 is provided for fixing the resilient body 150 at a stable position.

In the third embodiment, the high voltage wire connection structure described in the second embodiment is applied to the connection of the draw-out conductor 127 to the high voltage wire, by way of example. Though description thereon is omitted, the accelerating voltage supplied from FBT (not shown) is transferred through the high voltage wire 144, high voltage terminal 146, resilient body 150, draw-out conductor 127, and metal sheet 120, and applied to the metal back 114. The accelerating voltage thus applied causes electron beams emitted from the electron emission element forming layer 19 to accelerate toward the optically transparent substrate 110, collide with the luminescent materials 111 contained in the miniature holes 122 of the metal sheet 120 to excite the luminescent materials 111 which are consequently driven to emit light.

It should be noted that the conductivity of the metal sheet 120 made of the Fe—Ni based alloy is as low as three, as compared with the conductivity of the metal back 114 made of aluminum equal to 62, with reference to the conductivity of copper which is set to 100 (Electric/Electronic Material Handbook, pp.597–602, first published in 1987 by Asakura Shoten). However, the thickness of the metal sheet 120 is larger than 25 μm by a factor of 100 or more, as compared with the thickness of the metal back 114 which is approximately 100 nm, so that the metal sheet 120 has a sheet resistance which is lower than that of the metal back 114 by a factor of approximately 4.8 (=300/62) or less, thereby making it possible to reduce a resistive loss of the accelerating voltage by a parallel connection of the metal back 114 with the metal sheet 120.

As described above, according to the third embodiment, a thin metal sheet is formed with a large number of miniature holes into which the luminescent materials are charged. One side of the metal sheet formed with a black oxide film is used as a black matrix for improving the contrast. Further, since a plurality of recesses are formed on the other opposite side of the metal sheet, and spacers are inserted into these recesses, the spacers can be accurately and readily assembled without degrading the contrast.

In the first and second embodiments, the conductor 117 is drawn out of the metal back 114, whereas in the third embodiment, the metal sheet 120 having the draw-out conductor integrally formed therewith can eliminate a work for forming the conductor 117 drawn out of the metal back 114 using a metal paste or the like. The third embodiment is also advantageous in an improved reliability resulting from the integral formation of the metal sheet 120 with the draw-out conductor. In addition, the third embodiment is advantageous in that the parallel connection of the metal sheet 120 and metal back 114 can electrically reduce a resistive loss of the accelerating voltage, and can also reduce a luminance slope associated with the resistive loss.

While the foregoing third embodiment employs the high voltage wire connection structure described in the second embodiment for connection to the high voltage wire, the connection is not limited to this particular structure, but the high voltage connection structure described in the first embodiment may be used instead, as a matter of course.

Figure 9:
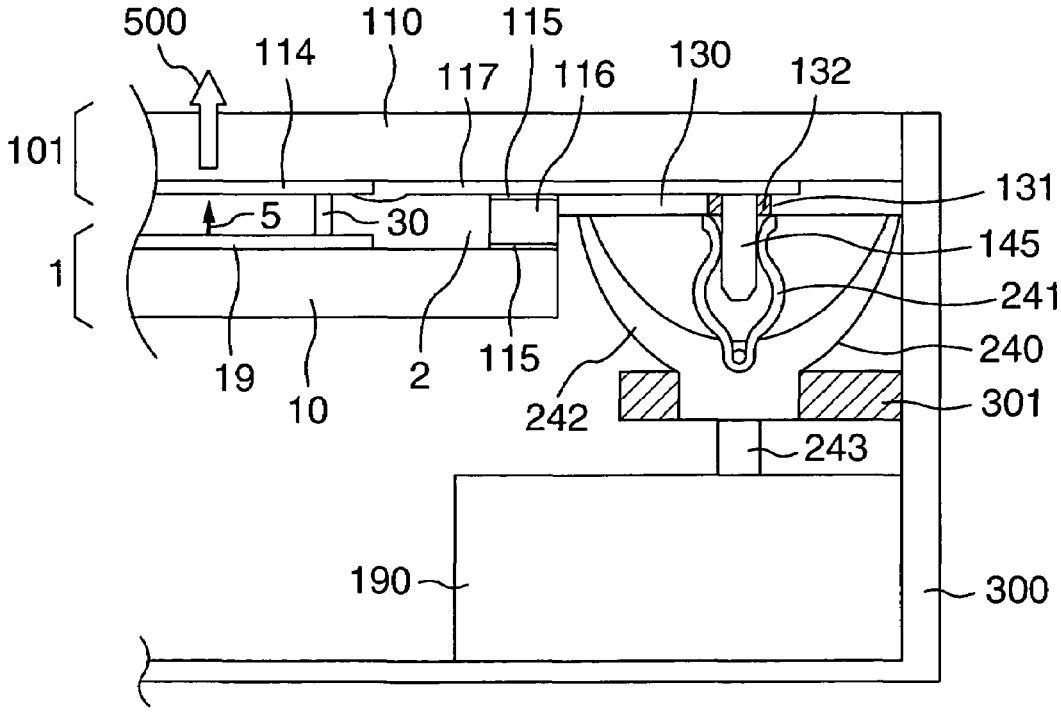
FIG. 9 is a diagram illustrating a flat display device according to a fourth embodiment of the present invention.

Next, FIG. 9 illustrates a fourth embodiment. FIG. 9 is a modification to the first embodiment illustrated in FIG. 1. Specifically, a high voltage connector is disposed in a housing which contains a driving circuit and a power supply circuit for a flat display device. When the flat display device is assembled into the housing to complete an image display device, a high voltage terminal disposed in the flat display device is fitted into the high voltage connector in the housing. Therefore, the following description will be focused only on differences in the third embodiment, and omit those features previously described in connection with the first embodiment. FIG. 9 illustrates the high voltage connector fitted into the high voltage connector.

In FIG. 9, a holder plate 301 is mounted for securely holding the high voltage connector 240 in the housing 300 which contains a driving circuit (not shown), a power supply circuit (not shown), and an FBT 190 of a flat display device. The high voltage connector 240 is securely held by the holder plate 301.

The high voltage connector 240 comprises a bifurcated contactor 241 in contact with a metal rod of the high voltage terminal 145 in the flat display device; an anode cap 242 made of insulating silicone rubber or the like; and a high voltage wire 243 connected to the FBT 190.

With the configuration as described above, an accelerating voltage supplied from the FBT 190 is applied to the contactor 241 through the high voltage wire 243, and to the metal rode of the high voltage terminal 145 which is fitted into the bifurcated contactor 241.

In the fourth embodiment, since the high voltage connector 240 is mounted in the housing 300, the high voltage connector 240 can be fitted into the high voltage terminal 145 without fail, as compared with the first embodiment. Thus, the high voltage connector 240 will not unexpectedly come off by any cause, and therefore excels in the reliability.

It should be understood that the fourth embodiment can be applied to a combination of the flat display device of the third embodiment with the high voltage connection structure described in the first embodiment. Also, while the high voltage connection structure in the fourth embodiment has the high voltage terminal 145 on the flat display device in a plug (male) configuration, and the high voltage connector 240 in the housing 300 in a bifurcated socket (female) configuration, the high voltage connection structure is not limited to this combination. For example, the high voltage connection structure may comprise the contactor 241 of the high voltage connector 240 in the shape of a plug having a resilient leading end which is inserted into the throughhole 131, from which the metal rod of the high voltage terminal 145 is removed in the flat display device, to establish a contact therebetween, as will be understood as a matter of course. Such a modified embodiment will be shown below.

Figure 10A:
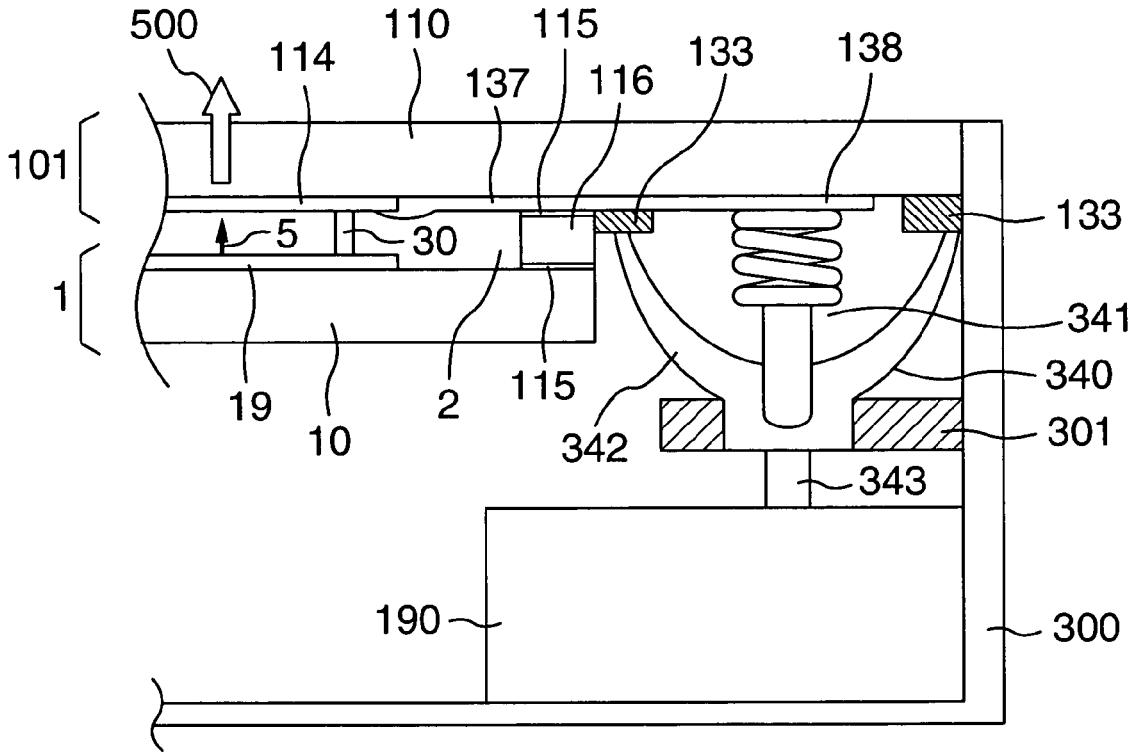
FIGS. 10A and 10B are diagrams illustrating a flat display device according to a fifth embodiment of the present invention.
Figure 10B:
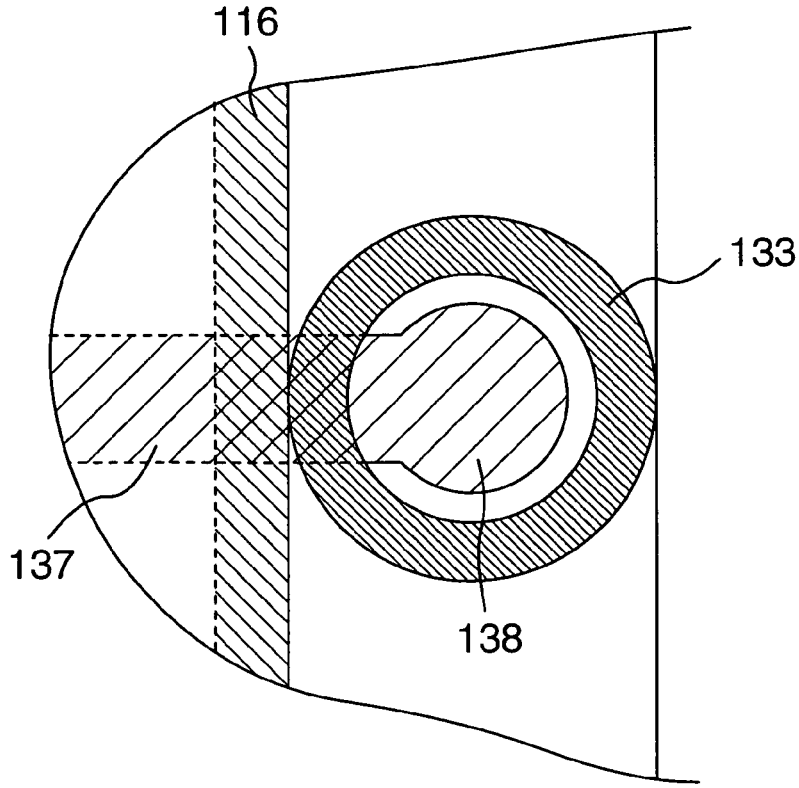

FIGS. 10A and 10B illustrate a fifth embodiment, where FIG. 10A is a side view of an image display device, and FIG. 10B is a top plan view of a predetermined region outside of the vacuum chamber, to which the conductor is drawn out. The fifth embodiment is identical in the basic structure to the fourth embodiment illustrated in FIG. 9, and employs a plug configuration for the high voltage connector. In FIGS. 10A and 10B, parts having the same functions as those in FIG. 9 are designated the same reference numerals, and description thereon is omitted.

As can be seen in FIG. 10B, a toroidal insulating layer 133 is provided in contact with the vacuum chamber 2 on the conductor 137 drawn out of the metal back 114 to the predetermined region outside of the vacuum chamber 2 of the flat display device. The insulating layer 133 surrounds an electrode 138 of the drawn conductor 137. The insulating layer 133, which prevents a discharge from the electrode 138, has a predetermined width and thickness, such that a leading end of an anode cap 342 of a high voltage connector 340, later described, comes into contact with the insulating layer 133 within the width of the toroidal shape. The high voltage connector 340 is securely held by the holder plate 301 of the housing 300.

The high voltage connector 340 comprises a plug 341 having a resilient leading end, formed of a spring or the like, which comes into contact with the electrode 138 of the conductor 137 in the flat display device; the anode cap 342 made of an insulating silicone rubber or the like; and a high voltage wire 343 connected to the FBT 190.

With the configuration as described above, an accelerating voltage supplied from the FBT 190 is applied to the plug 341 through the high voltage wire 343, to the electrode 138 in contact with the plug 341, and to the metal back 114 through the conductor 137. The electrode 138 and plug 341 are covered with the anode cap 342, so that even if a metal material approaches to these components, no air discharge will be produced between the metal material and components.

As described above, according to the present invention, a conductor for leading a high voltage power supply to a metal back is drawn out to a predetermined region outside of a vacuum chamber, when viewed from a light exiting side, so that extra sealing is not required for the maintenance of vacuum, when the conductor is connected to a high voltage terminal. Consequently, a flat display device provided by the invention excels in the workability. In addition, the present invention can improve the reliability of the flat display device.

It should be further understood by those skilled in the art that although the foregoing description has been made on embodiments of the invention, the invention is not limited thereto and various changes and modifications may be made without departing from the spirit of the invention and the scope of the appended claims.

What is claimed is:

1. A display device comprising:

a back substrate formed with a plurality of electron emission elements;

a display substrate disposed opposite to said back substrate, said display substrate including an accelerating electrode applied with an accelerating voltage for accelerating electrons from said electron emission elements, and luminescent materials for emitting light when said luminescent materials come into collision with the electrons accelerated by the accelerating voltage;

a frame member for supporting said back substrate and said display substrate on the peripheries thereof, said frame member, said back substrate, and said display substrate surrounding a space to define a vacuum area; and a conductor connected electrically to said accelerating electrode, applied with the accelerating voltage, and routed outside of said frame member which forms said vacuum area, wherein said conductor includes a connection part extending from said conductor and onto which a connector is removably connectable for supplying the accelerating voltage.

2. A display device according to claim 1, wherein said conductor is routed on a side of said display substrate opposite to said back substrate outside of said vacuum area.

3. A display device according to claim 1, wherein said connection part includes a rod member extending in a direction substantially orthogonal to a plane including said conductor, and said connector is removably fitted over said rod member.

4. A display device according to claim 3, wherein said connector comprises an insulating cap for covering an end of said conductor and said rod member.

5. A display device according to claim 1, wherein a distance between an end of said conductor and an end of an optically transparent substrate is in a range of 2 to 5 mm, said optically transparent substrate constituting said display substrate.

6. A display device comprising:

a back substrate including an insulating substrate, and a plurality of electron emission elements formed on said insulating substrate;

a display substrate including an optically transparent substrate disposed opposite to said back substrate, an accelerating electrode plate disposed on an inner face of said optically transparent substrate and applied with an accelerating voltage for accelerating electron beams emitted from said electron emission elements, and a luminescent material layer excited by the electron beams accelerated by the accelerating voltage to emit light to the outside of said optically transparent substrate;

a frame member for supporting said back substrate and said display substrate on the peripheries thereof, said frame member, said back substrate, and said display substrate surrounding a space to define a vacuum chamber; and a conductor connected electrically to said accelerating electrode plate, embedded between said optically transparent substrate and said frame member, and drawn out to a predetermined region outside of said frame member for forming said vacuum chamber, when viewed from a light exiting side, toward said back substrate on said optically transparent substrate, wherein said conductor includes a connection part extending from said conductor, and onto which a connector is removably connectable for supplying the accelerating voltage.

7. A display device according to claim 6, wherein:

said optically transparent substrate and said insulating substrate are both substantially rectangular;

said conductor is drawn out to one longer side of said optically transparent substrate; and said optically transparent substrate has shorter sides longer than shorter sides of said insulating substrate.

8. A display device according to claim 7, wherein:

said vacuum chamber is substantially rectangular in shape when viewed from a light exiting side; and a distance in a shorter side direction between one longer side of said vacuum chamber and one longer side of said optically transparent substrate sandwiching said predetermined region of said optically transparent substrate is longer than a distance in the shorter side direction between the other longer side of said vacuum chamber and the other longer side of said optically transparent substrate.

9. A display device according to claim 6, wherein:

said optically transparent substrate and said insulating substrate are both substantially rectangular;

said conductor is drawn out to one shorter side of said optically transparent substrate; and said optically transparent substrate has longer sides longer than longer sides of said insulating substrate.

10. A display device according to claim 9, wherein:

said vacuum chamber is substantially rectangular in shape when viewed from a light exiting side; and a distance in a longer side direction between one shorter side of said vacuum chamber and one shorter side of said optically transparent substrate sandwiching said predetermined region of said optically transparent substrate is longer than a distance in a longer side direction between the other shorter side of said vacuum chamber and the other shorter side of said optically transparent substrate.

11. A display device according to claim 6, wherein:

said back substrate includes a driving wire for driving said electron emission elements, and an electrode area to which an electrode is drawn out for connection to said driving line; and said conductor is routed along a side on which said electrode area is not formed.

12. A display device according to claim 6, wherein:

said display substrate comprises a plurality of miniature holes arranged in matrix, said miniature holes containing said luminescent materials to form a light emitting area, and a metal sheet disposed on a side of said display substrate closer to said back substrate and having a plurality of recesses for vertically holding supporters;

said metal sheet is secured to an inner face of said optically transparent substrate through an adhesive layer, and said metal sheet has said accelerating electrode plate electrically connected to said metal sheet on a side of said metal sheet closer to said back substrate; and a portion of said metal sheet is embedded between said adhesive layer and said frame member, and integrally drawn out to said predetermined region to constitute said conductor.

13. A display device according to claim 12, wherein said metal sheet is mainly composed of Fe—Ne.

14. A display device according to claim 6, further comprising a conductive resilient body in electric contact with a high voltage terminal for supplying the accelerating voltage, wherein said conductor includes a recess formed therein for fitting said resilient body thereinto, said resilient body being pressed in a thickness direction of said display substrate to fit said resilient body into said recess.

15. A display device comprising:

a back substrate having a plurality of electron emission elements formed thereon;

a display substrate disposed opposite to said back substrate, said display substrate comprising an accelerating electrode applied with an accelerating voltage for accelerating electrons from said electron emission elements, and luminescent materials for emitting light when said luminescent materials come into collision with the electrons accelerated by the accelerating voltage;

a frame member for supporting said back substrate and said display substrate on the peripheries thereof, said frame member, said back substrate, and said display substrate surrounding a space to define a vacuum area; and a conductor connected electrically to said accelerating electrode and which includes a connection part extending from said conductor and onto which a connector is removably connectable for supplying the accelerating voltage, wherein said back substrate is formed with a driving wire for said electron emission elements, said driving wire being drawn out to one or a plurality of sides of said back substrate, and wherein said conductor is routed out a side of said display substrate on which said driving wire is not disposed, and said conductor is drawn to the outside of said vacuum area.

* * * * *